United States Patent [19]

Holmes, Jr.

[11] 4,405,244

[45] Sep. 20, 1983

[54] TYPEWRITER OPERATING ATTACHMENT PROVIDING FOR DEAD KEY OPERATIONS

[76] Inventor: Lawrence Holmes, Jr., 91 Highwood Ave., Midland Park, N.J. 07432

[21] Appl. No.: 285,503

[22] Filed: Jul. 21, 1981

[51] Int. Cl.[3] ..... B41J 5/30

[52] U.S. Cl. ..... 400/66; 400/22; 400/301

[58] Field of Search ..... 400/66, 301, 302, 300, 400/22

[56] References Cited

U.S. PATENT DOCUMENTS

| | | | |
|---|---|---|---|
| 3,452,851 | 7/1969 | Holmes, Jr. . | |
| 3,453,379 | 7/1969 | Holmes, Jr. . | |
| 3,643,773 | 2/1972 | Holmes, Jr. . | |
| 3,646,573 | 2/1972 | Holmes, Jr. . | |
| 3,658,161 | 4/1972 | Holmes, Jr. | 400/66 |
| 3,927,752 | 12/1975 | Jones et al. | 400/487 |
| 4,023,664 | 5/1977 | Baffo et al. | 400/62 |

OTHER PUBLICATIONS

IBM "Selectric" Typewriter Service Manual, 1980, pp. 76, 81, 241, and 242.

*Primary Examiner*—Paul T. Sewell

*Attorney, Agent, or Firm*—Phillips, Moore, Lempio & Finley

[57] ABSTRACT

A baseplate attachment (12) having actuator elements which extend into an electrical typewriter (13) to initiate operations in response to signals indicative of successive characters to be printed further provides for dead key print operations when desirable including at typewriters which have no built-in mechanism for such purpose. Dead key mechanism (11) on the attachment responds to a dead key signal in conjunction with a print signal by suppressing the character spacing escapement operation of the typewriter that normally follows printing of a character. The capability of dead key printing simplifies and speeds certain operations during automatic printout. For example, underscored characters may be printed without back spacing operations. If a specialized printing element with two underscores is used in the typewriter, the underscoring may also be accomplished without case shift operations. Repetitive printings of a character at a single space may be made to provide boldface emphasis. In the preferred form of the invention, the dead key mechanism of the attachment need not be directly fastened to any internal element of the typewriter and no internal modifications of a standard commercial typewriter are required to enable use of the dead key mechanism.

12 Claims, 6 Drawing Figures

TYPEWRITER OPERATING ATTACHMENT PROVIDING FOR DEAD KEY OPERATIONS

TECHNICAL FIELD

This invention relates to automatic typing and more particularly to attachments for actuating electrical typewriters in response to signals which identify typewriter operations to be performed.

BACKGROUND OF THE INVENTION

Systems which process information in the form of coded signals typically require an output device for printing information represented by the signals. Output devices of this kind are employed in connection with computers and in long distance message transmission for example. Office typewriters have also evolved into data processing systems of this type. In the so-called word processing or editing typewriters, the typist's keyboard operations generate signals which are recorded for subsequent retrieval and automatic printout.

To enable operation of a typewriter in response to electrical signals it was originally thought necessary to provide a highly modified typewriter of costly construction. More recently it has been found to be much more practical to utilize commercial office typewriters which are manufactured and sold without specialized internal mechanisms for the purpose of initiating typewriter operations in response to electrical signals. This is made possible through the use of a typewriter attachment which may be engaged with the typewriter and which, in the preferred forms, requires little or no modifications to the moving internal operating mechanisms of the typewriter.

Sensing elements of the attachment extend into the typewriter mechanism to detect print and function operations of the typewriter as initiated by a typist and to generate electrical signals which identify such operations. Actuator elements of the attachment extend into the typewriter to initiate operations in response to such electrical signals. Typewriter baseplate attachments of this kind are described in detail in U.S. Pat. No. 3,452,851 of L. Holmes, Jr., issued July 1, 1969 and entitled, *TYPEWRITER BASEPLATE ENABLING MACHINE OPERATION BY AND GENERATION OF ELECTRICAL SIGNALS* and in U.S. Pat. No. 3,658,161 of Lawrence Holmes, Jr., issued Apr. 25, 1972 and entitled, *DATA INPUT MECHANISM FOR AN ELECTRICAL TYPEWRITER.*

As heretofore constructed, attachments of this type are not able to initiate dead key print operations. In a dead key operation, printing of a character is not followed by the carriage movement to a succeeding printing space that normally accompanies the printing of a character by a typewriter. This enables a subsequent character to be printed at the same space without requiring back spacing.

Some commercial typewriters have built-in mechanism capable of dead key operation. Such built-in dead key mechanism is typically found in typewriters designed for printing in languages where constructed characters are required, such as the addition of an accent, a grave or a circumflex over a standard alphabet character. In such typewriters the dead key character key is customarily struck first so that, for example, an accent prints on the paper but the usual operation of the typewriter escapement mechanism does not occur. The alphabet character key is then struck causing the alphabet character to be printed at the same character space. The typewriter escapement actuates in the normal manner in conjunction with printing of the alphabet character.

Dead keys are not necessarily required in the typing of certain languages, such as the English language for example, and thus there is no built-in dead key mechanism in many typewriters. There are a number of circumstances, especially in connection with word processing or automatic typing operations, where dead key operation would be advantageous in English language typewriters or in others which also lack built-in mechanism for the purpose.

For example, if a line of characters is to be underscored the typist will usually type the entire line, then back space across the page and then underscore the line. In the automatic printing of such typing from stored signals, it is often better to print each character and underscore it immediately rather than to follow the original sequence of operations of the typist. Because of the problems of tracking underscoring and limitations on buffer space in computer logic design, the conventional computer technique is to print each character, back space and then print the individual underscore for that character before proceeding on to the next character.

Because of internal mechanical constraints, electrical typewriters usually use two character time periods to back space. The conventional underscore is an uppercase character. Consequently, in automatic typing the underscoring of a uppercase alphabet character has required one time period to print the letter, two time periods to back space and one time period to underscore for a total of four time periods.

Automatic underscoring of a lowercase character has been even more time consuming. An uppercase shift and a lowercase shift each require an additional time period. If a lowercase character is to be underscored then the conventional procedure, in automatic typing, is to print the lowercase character, shift to uppercase, back space, print the underscore, then shift to lowercase in preparation for printing of the next lowercase character. In this case, six time periods are required to print a single underscored character.

If the typewriter operating attachment were able to initiate a dead key operation, the time consumed in back spacing could be saved thereby significantly speeding up the printout of underscored text. If the need for case shifts in connection with underscoring were eliminated, still greater time savings could be realized.

Another problem encountered in typewriters operated by an attachment which responds to coded signals is the unavailability of any convenient means for emphasizing specific words. Typically, it is necessary to stop the automatic printout at the appropriate point and temporarily exchange the printing element of the typewriter for another which carries italic characters. This is a very time consuming and inconvenient operation if it must be done manually.

The present invention is directed to overcoming one or more of the problems as set forth above.

SUMMARY OF THE INVENTION

In one aspect of the present invention, an attachment initiates operations of a typewriter in response to electrical signals which identify successive operations to be performed, the typewriter having escapement means for causing character spacing movement to a succeeding character space following printing of a character in response to a print signal. The attachment is provided with dead key means for temporarily disabling the escapement means of the typewriter in response to a dead key signal in conjunction with a print signal.

In another aspect of the invention the escapement means of the typewriter has a trigger member movable between a first position at which operation of the escapement means is prevented and a second position at which the escapement means is released for operation. The dead key means of the attachment includes a movable trigger finger positioned to extend adjacent the typewriter trigger member when the attachment is engaged with the typewriter. The trigger finger has an operated position at which the typewriter trigger member is maintained at the first position by the trigger finger and has an unoperated position at which the typewriter trigger member is released for movement to the second position.

In still another aspect of the invention, the attachment further includes latching means for holding the trigger finger at the operated position for a predetermined period following termination of the print signal and the dead key signal.

In still another aspect of the invention in which the typewriter has a printing element with first and second underscore mark characters respectively located for printing an underscore when the typewriter is in the uppercase condition and in the lowercase condition, the attachment includes control means for providing the dead key signal to the dead key means in conjunction with a print signal for initiating printing of an underscore with the first underscore mark when the character to be underscored is uppercase and for printing with the second underscore mark when the character to be underscored is a lowercase character.

In still another aspect, the attachment includes control means for repetitively providing a predetermined specific character print signal and for providing the dead key signal in conjunction with repetitions of the specific character print signal whereby the character identified by the specific print signal is printed in boldface print.

The invention provides for dead key print operations, when desirable, at typewriters which are actuated by an attachment that responds to coded signals indicative of successive characters to be printed. The typewriter itself need not necessarily have any manually actuatable built-in dead key mechanism. The invention simplifies and speeds the automatic printing of text from coded signals in connection with certain types of characters to be printed. For example, underscoring may be printed without back spacing and, in a preferred form of the invention, without case shifting. Selected characters, words or phrases may be emphasized, by being printed in boldface print, as a result of multiple printings of characters without requiring back spacing between each repetitive printing of such characters. In a preferred form of the invention, no specialized internal modifications of a commercial typewriter are needed to accommodate to the attachment including the dead key mechanism. Movable elements of the attachment need not be directly fastened to internal mechanism of the typewriter and mechanical power for operating the attachment print components including the dead key mechanism is obtained from the cycling motor of the typewriter itself.

The invention, together with further objects and advantages thereof, will be better understood by reference to the accompanying drawings and the following description of detailed examples.

DETAILED DESCRIPTION OF AN EMBODIMENT OF THE INVENTION

Figure 1:
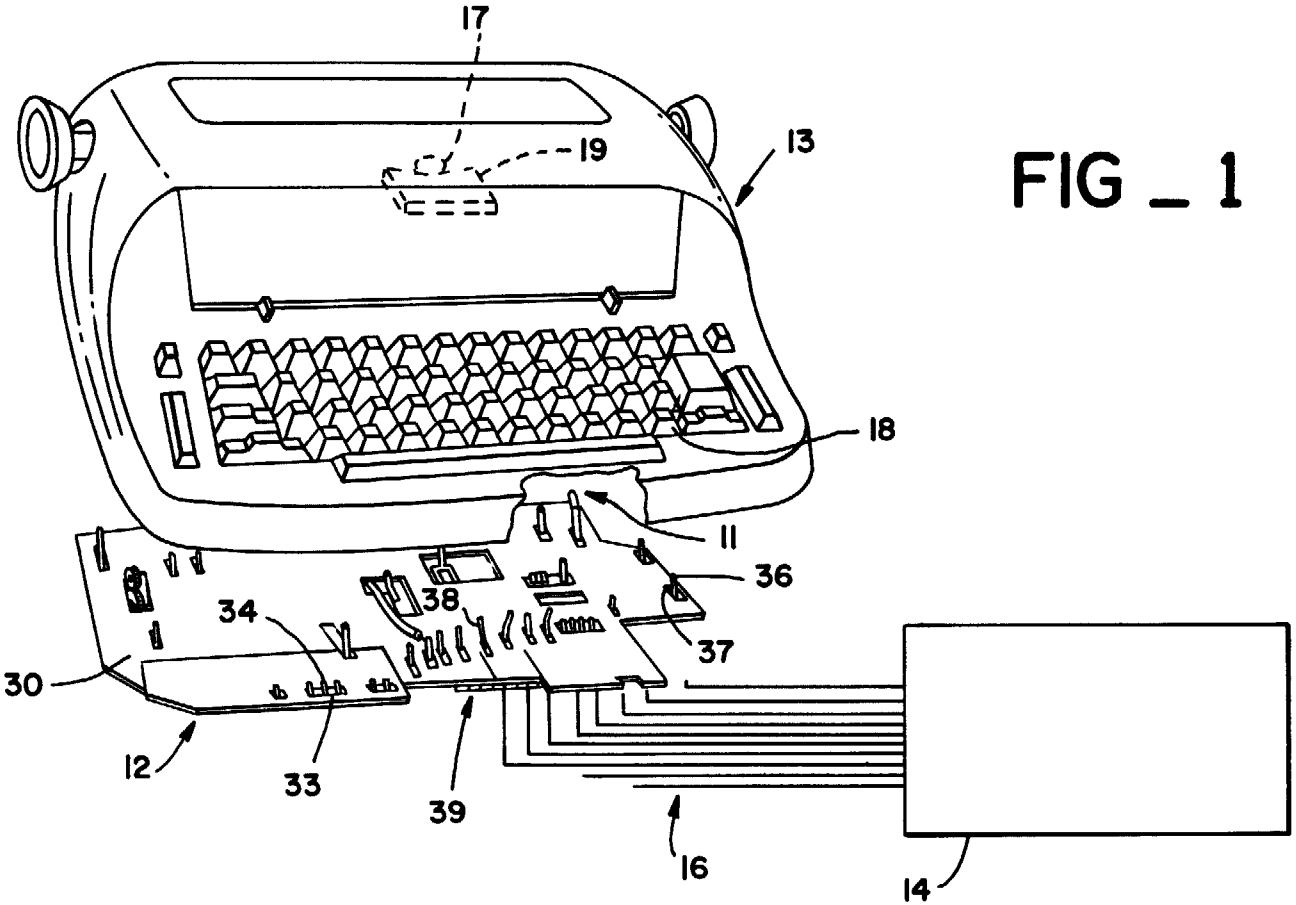
FIG. 1 is a perspective view of an electrical typewriter together with a baseplate attachment in accordance with an embodiment of the invention which enables operation of the typewriter in response to electrical signals, the baseplate attachment being shown slightly separated from the typewriter for clarity of illustration.

Referring initially to FIG. 1 of the drawing, dead key means 11 in accordance with an embodiment of the invention is provided on a typewriter attachment 12 of the form which operates an electrical typewriter 13 in response to coded signals that identify successive operations to be performed by the typewriter. The attachment 12 of this embodiment is a typewriter baseplate of the general type described in my above identified prior U.s. Pat. No. 3,658,161 except insofar as the dead key means 11 has been added to the attachment. The typewriter 13 may be a standard office typewriter of the type manufactured by the IBM Corporation under the trademark "Selectric" although an essentially similar baseplate attachment may be adapted for use with other specific commercial typewriter models as well. As the typewriter 13 and most of the components of the baseplate attachment 12 may be of known form, such mechanisms will herein be described only briefly to the extent necessary to facilitate an understanding of the coaction of the dead key means 11 therewith.

Components of attachment 12 are coupled to control means 14 through a plurality of electrical conductors 16 and function to generate coded electrical signals indicative of successive print and function operations initiated by a typist. The attachment 12 also functions to initiate typewriter operations in response to such electrical signals during automatic printout. The signals produced by the attachment 12 in response to manual operation of the typewriter 13 may variously be temporarily stored within the control means 14 for later recall and automatic printout as in word processing typewriters or may be transmitted to a distant location for printout by a receiving typewriter in message transmission systems or may be transmitted to a computer, depending on the nature of the installation. Similarly, the source of signals for automatic operation of the typewriter 13 by the attachment 12 may variously be recorded signals previously generated at the same typewriter or signals originating from a distant similar installation or from a computer.

Figure 2:
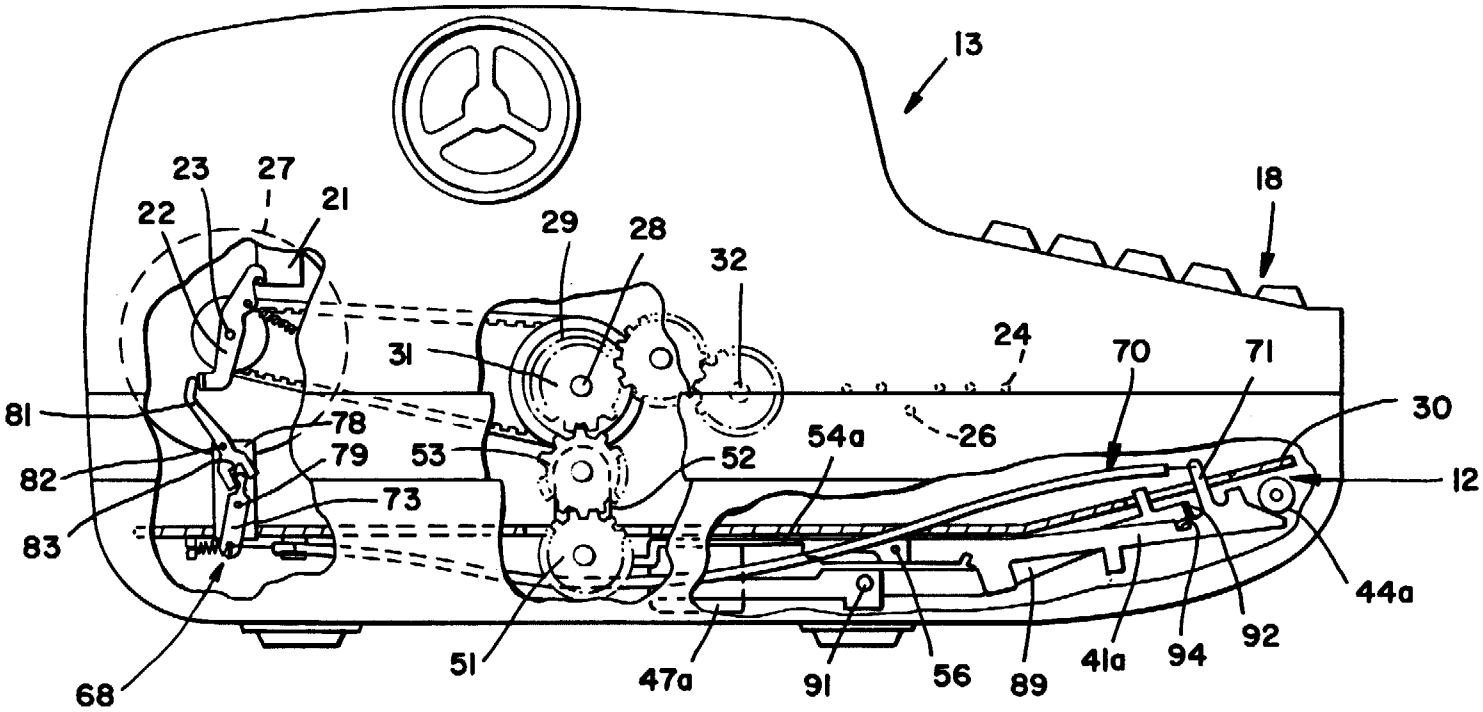
FIG. 2 is a broken out side elevation view of the typewriter of FIG. 1 showing the baseplate engaged therewith and depicting dead key operation initiating means on the baseplate in accordance with an embodiment of the invention.

The character imprinting means of a typewriter of the particular known type identified above is a spherical printing element 17 carrying a complete set of alphanumeric characters and punctuation marks or other symbols to be printed. The printing element 17 rotates and tilts in response to depression of the typewriter print keys 18, to impress the selected characters on the paper, and together with a carrier 19 shifts transversely a distance of one character space in the course of each print operation cycle. Referring to FIG. 2, the character spacing movement or escape of the typewriter in the course of a print cycle is provided for by escapement means 21 which includes a trigger member 22 which pivots about an axis 23 between a first position at which operation of the escapement means is prevented and a second position at which escape may proceed. The lower end of the trigger member 22 is held forward at the first position during the initial stages of a print cycle and is then pivoted back to the second position at a later stage in the cycle to allow escape to proceed. This delays the escapement means 21 operation until after printing of the character has occurred.

A typewriter 13 of this particular known type also has a series of six transverse rods or code bails 24 each of which may be shifted a small distance towards the front of the typewriter. Depression of specific ones of the print keys 18 of the typewriter acts to shift a combination of code bails 24 which is unique for that particular key. Thus the position of the code bails 24, considered collectively, identifies a print operation, if any, to be carried out at a particular time. The typewriter 13 also has a transverse cycle bail 26 which is shifted forward by depression of any one of the print keys 18. The typewriter further includes a continuously operating drive motor 17 and a rotatable cycle shaft 28 which may be selectively coupled to the drive motor 27 by engagement of a cycle clutch 29. Forward shifting of the cycle bail 26 by depression of any of the keys 18 engages the cycle clutch 29 temporarily in order to turn the cycle shaft 28 through 180° of angular motion. Cycle shaft 28 carries a cycle shaft gear 31 which drives a filter shaft 32 and the other mechanisms within the typewriter which must operate to perform the operation identified by the particular key 18 which was depressed. The collective positions of the code bails 24 as a print cycle begins determines the movement of the spherical printing element 17 to cause printing of the particular character which corresponds to the depressed key 18.

Certain typewriter operations initiated by striking particular keys, of which space, back space and case shifts are examples, are termed function operations to distinguish from print operations which result in the printing of a character. Referring again to FIG. 1, to generate signals in response to manual operation of the typewriter 13 the attachment 12 includes a plate 30 supporting switches 33 which are operated by arms 34 that extend up into appropriate locations to sense movements of the typewriter mechanism which occur in the course of both the print and function operations initiated by manual striking of the typewriter keys 18. Automatic operation of the typewriter 13 in response to signals identifying function operations is provided for by a first group of operating arms 36 controlled by electrical solenoid coils 37. Arms 36 extend from the plate 30 up into the typewriter mechanism to manipulate the appropriate typewriter control elements when a set of received signals indicates that the typewriter is to perform a function operation. A second group of solenoid controlled movable arms 38, termed interposer fingers, extend upward from the plate 30 in position to shift the particular combination of the typewriter code bails 24 (shown in FIG. 2) that identifies a particular character to be printed in response to a set of print signals. In a preferred form of the present invention, portions of the dead key means 11 are situated in the interposer assembly 39 which operates the interposer fingers 38. Accordingly, the construction of the interposer assembly 39 will be discussed in more detail to facilitate an understanding of the combining of elements of the dead key means 11 into the assembly.

Figure 3:
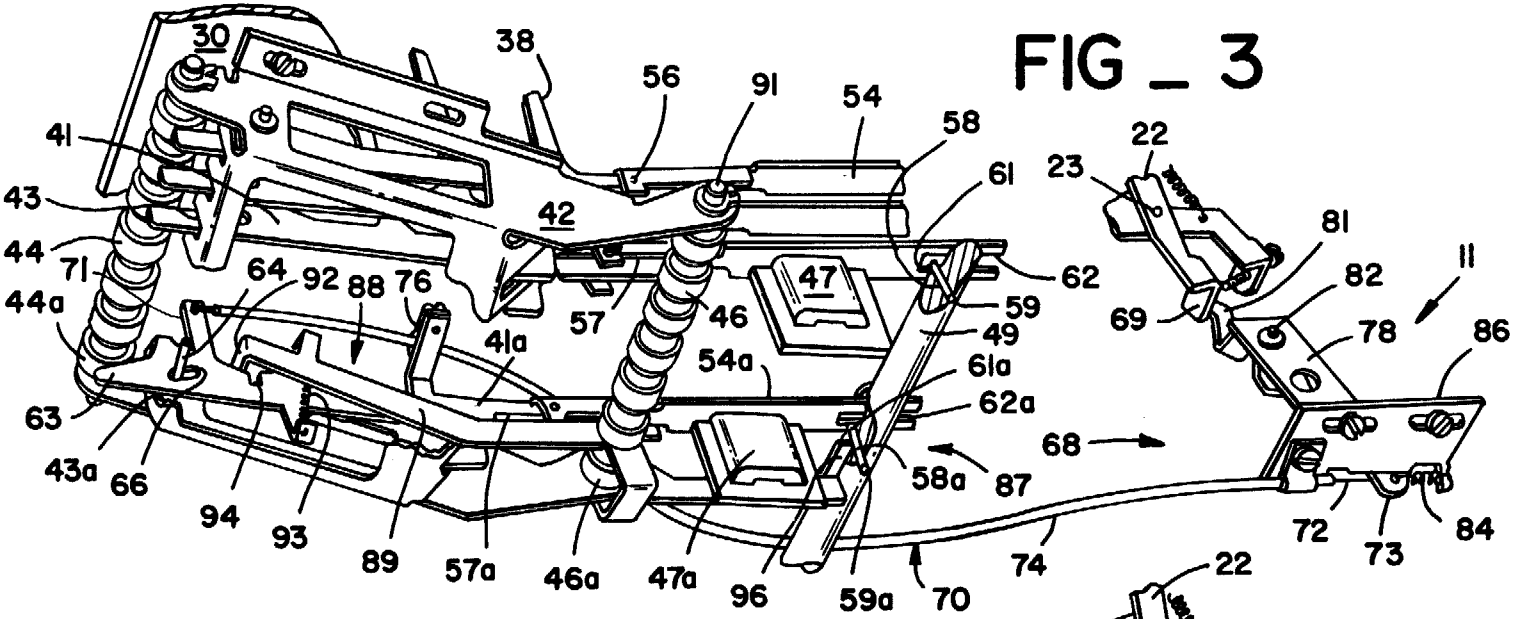
FIG. 3 is a perspective view of a portion of the underside of the baseplate attachment of FIGS. 1 and 2 showing elements of the dead key operation mechanism of the attachment in greater detail.
Figure 4:
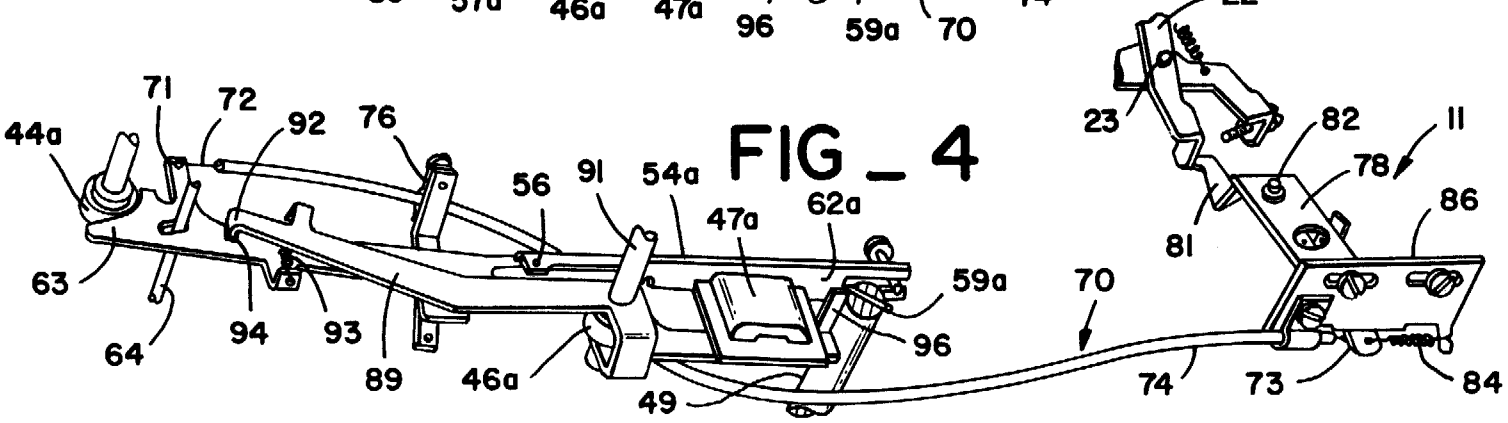
FIG. 4 is a perspective view of a portion of the structure depicted in FIG. 3 shown in the operated condition in response to a dead key signal.

Referring to FIG. 3, a series of parallel slideable interposer members 41 are mounted in a frame or cage 42 secured to the underside of plate 30 and each carries an individual one of the previously described interposer fingers 38 that extend upwardly from the baseplate in position to shift an associated one of the code bails of the typewriter. Cage 42 is provided with slots 43 and front and rear rollers 44 and 46 respectively for positioning and guiding the print interposers 41 while enabling a limited amount of longitudinal sliding movement of each interposer in the forward and backward directions. Returning momentarily to FIG. 2, each of the code bails 24 in a typewriter 13 of this form is spring biased towards the rearward position of the code bail by internal elements of the typewriter. Referring again to FIG. 3, each of the interposers 41 is normally held at the rearward position by the typewriter itself as the finger 38 of each interposer member extends to a position just to the rear of the associated one of the typewriter code bails. Accordingly, the typewriter 13 may be conditioned to print a specific character by momentarily advancing the particular ones of the interposers 41 of attachment 12 that have fingers 38 contacting the particular ones of the code bails of the typewriter that must be shifted forward to initiate printing of the particular character.

While electrical actuators may be utilized to momentarily drive the appropriate ones of the interposers 41 forward in response to a set of electrical print signals, it is preferable to obtain the mechanical power for the interposer movement from the typewriter itself and to use electrical actuators 47 only for the purpose of initiating the interposer movement rather than for driving the actual movement. This enables the use of substantially smaller actuators which can be more easily fitted into the mechanism and also reduces heat generation from high electrical currents.

In particular, the attachment 12 includes a rotatable filter shaft 49 which extends transversely beneath plate 30 behind the interposers 41. Referring now to FIG. 2, a filter shaft gear 51 is situated at one end of the filter shaft 49. A bracket 52 extends upward from baseplate 12 to support an intermediate gear 53 that engages with cycle shaft gear 31 of the typewriter when the baseplate attachment 12 is emplaced at the typewriter. Filter shaft gear 51 of attachment 12 has the same diameter as the typewriter cycle shaft gear 31. Thus when the typewriter cycle shaft gear 31 is turned through 180° of rotation in the course of a print cycle as previously described, filter shaft 49 of the attachment 12 is synchronously turned through the same amount of rotational movement.

Referring again to FIG. 3, a driver member 54 is coupled to the back end of each interposer member 41 at a pivot joint 56 and extends rearwardly a small distance past the top of the attachment filter shaft 49. A wire spring 57 extends between each interposer 41 and the associated driver member 54 and is positioned to bias the driver member upwardly to a normal position at which the driver member is spaced sligthly above the filter shaft 49. The filter shaft 49 carries a series of kicker pins 58 which extend diametrically through the shaft and which have opposite ends 59 and 61 that extend outwardly from the shaft a small distance. Each kicker pin 58 of the filter shaft 49 is situated immediately below the back end of an associated individual one of the driver members 54. Each driver member 54 has a slot 62 at the back end immediately above the associated one of the kicker pins 58 of the filter shaft.

Driver members 54 are formed at least in part of ferromagnetic material and one of the series of small electrically operated actuators 47 is situated below each such driver member. Each actuator 47 has a ferromagnetic core and a coil which receives a separate bit component of the binary set of signals which initiate a print operation of the typewriter. Accordingly when a set of such signals is received, different ones of the series of actuators 47 are momentarily energized depending on the particular character which is represented by the set of signals.

Prior to the start of a typewriter print operation in response to receipt of a set of print signals, the filter shaft 49 is at a position at which one end 61 of the kicker pins 58 is directed towards slot 62 of the associaed one of the driver members 54 but is not within the slot as the driver member is held in a slightly lifted position by spring 57. If the associated actuator 47 is momentarily energized at the start of a print cycle the magnetic field of the actuator draws the driver member 54 downward causing pin end 61 to be entered into the slot 62 of the driver member. The beginning stage of the 180° of rotation which the filter shaft 49 undergoes in the course of the print cycle causes the end 61 of the kicker pin to momentarily urge driver member 54 forward. This in turn moves the associated interposer 41 and interposer finger 38 forward momentarily. Accordingly, a particular combination of the code bails 24 of the typewriter, depicted in FIG. 2, are momentarily shifted forward at the beginning of the print cycle and the typewriter is conditioned to print the specific character identified by the set of binary signals received at the attachment solenoids 47.

The dead key means 11 of the baseplate attachment 12, in this embodiment, is formed in part by an additional interposer member **41*a* which extends in parallel relationship to the print interposer members 41 and which is also supported in the interposer cage 42 for limited sliding movement in the forward and backward direction. The additional or dead key interposer member 41*a* is supported at the front end by a tapered tip 63 of the interposer member which extends through a vertical slot 43*a* at the front of interposer cage 42 the tip being positioned to contact the underside of an associated one of the front rollers 44*a* in position to ride forwardly and slightly downwardly along the roller when the interposer member 41*a* is advanced to the forward or operated position. The front end of the dead key interposer member 41*a* is further supported and guided by a transverse rod 64 at the front end of the interposer cage member 42, which extends through a slot 66 in the front end of the interposer member 41*a*, the slot having a configuration and orientation which accommodates to the forward and downward movement and which defines the limits of such movement. The back portion of the additional interposer member 41*a* is held adjacent the underside of baseplate 30 and is positioned and guided by an additional one 46*a* of the back rollers 46**.

Forward and backward motion of the additional interposer member **41*a* is transmitted to an escapement deactuator assembly 68 located on the plate 30 in position to extend upwardly to a location adjacent the back of the angled lower end 69 of previously described trigger member 22 of the typewriter when the attachment 12 is emplaced at the typewriter. For this purpose, in this example of the invention, dead key interposer member 41*a* has an upwardly extending finger 71 to which one end of the inner wire 72 of a sheathed wire cable 70 is secured and the opposite or back end of wire 72 is secured to the lower end of a dead key transfer link 73 of the escapement deactuator assembly 68. The outer sheath 74 of the cable 70 is clamped to interposer cage member 42 by a bracket 76**.

Referring now to FIG. 2, dead key transfer link 73 is mounted on an upwardly extending bracket 78 of assembly 68 for pivotal movement about a horizontal pivot axis 79 located at an intermediate point along the length of the link. Bracket 78 also carries a trigger finger 81 situated above transfer link 73 and which is supported for pivoting movement about another horizontal axis 82 situated above link 73 and at an intermediate location along the length of the trigger finger. The upper end of transfer link 73 is engaged in a slot 83 in the lower end of trigger finger 81. Thus pivoting movement of transfer link 73 causes an opposite pivoting movement of trigger finger 81. When the dead key interposer **41*a* moves forward to the operated position, cable 70 pulls the lower end of the transfer link 73 forward and this in turn pivots the upper end of trigger finger 81 forward to advance the lower end of the trigger member 22 of the typewriter 13. The typewriter trigger member 22 is then at the previously described first position at which the escapement means 21** of the typewriter is prevented from operating.

Returning to FIG. 3, a spring 84 connected between the lower end of transfer link 73 and a base member 86 of the assembly 68 urges the bottom of the transfer link rearwardly. The rearwardly acting spring force is transmitted to dead key interposer member **41*a* through cable 70. Thus in the absence of a counterforce, trigger finger 81 is normally held at the position at which it does not prevent operation of the typewriter trigger member 22 and at which the dead key interposer member 41*a*** is held at the rearward of unoperated position of the interposer.

Actuator means 87 are provided for causing movement of the interposer member **41*a* and thus the trigger finger 81*a* to the forward or operated positions in response to receipt of a dead key signal. The actuator means 87 in this embodiment includes an additional driver member 54*a* pivotally coupled at the forward end to interposer member 41*a* and which extends rearwardly beneath baseplate 12 and above filter shaft 49. A spring 57*a* urges the driver member 54*a* upwardly away from filter shaft 49 and an additional electrically operated actuator 47***a* is situated below the driver member 54*a* to draw the driver member downwardly towards filter shaft 49 when the actuator is energized by a dead key signal. An additional kicker pin 58*a* extends diametrically through the filter shaft 49 and has protruding ends 59*a* and 61*a* positioned to enter a slot 62*a* when the driver member is pulled downward at the start of a print cycle by energization of actuator 47*a*.

With the driver member 54*a* pulled downward, the kicker pin end 49*a* or 61*a* drives the dead key interposer member 41*a* forward to the operated position as the filter shaft 49 begins the 180° of rotation which occurs during a print cycle of the typewriter. The set of electrical signals including the dead key signal or bit terminates at an early stage in the print cycle which the set of signals has initiated. Unlike the print interposer members 41, which need to be urged forwardly only momentarily at the beginning of a print cycle in order to transmit character identifying data to the typewriter, the dead key interposer 41*a* is held at the forward or operated position for a period of time after the dead key signal has terminated. Latching means 88 for this purpose includes a latch member 89 which is adjacent dead key interposer member 41*a* and which is pivotable about the transverse axle 91 on which the rear rollers 46 of the interposer assembly are mounted. Latch member 89 has an angled front end 92 extending across the top of dead key interposer 41*a* and a spring 93 urges the front end of the latch member downwardly against the top of the interposer member 41*a*. The angled front end or detent 92 of latch member 89 is drawn into a notch 94 in dead key interposer 41*a* when the interposer 41*a* has been advanced to the forward or operated position. Thus the latch member 89 holds the dead key interposer 41*a* at the operated position after it has been advanced to that position at the start of a dead key print cycle as previously described.

Means for releasing the latching means 88 at the conclusion of the dead key print cycle includes an angled tab 96 on the back of latch member 89. Tab 96 is positioned to be contacted by the same kicker pin end 59*a* or 61*a* that drove the dead key interposer 41*a* forward at the start of that cycle when filter shaft 49 has completed 110° of rotation in the course of the cycle. At that stage of the cycle operation of the typewriter escapement is no longer possible owing to the internal construction of the typewriter itself. At this stage of the cycle, the kicker pin end 59*a* or 61*a* momentarily pushes tab 96 downward. This causes latch member 89 to lift detent 92 out of notch 94. Spring 84 then draws the dead key interposer 41*a* backward to the unoperated position.

Tab 96 is momentarily contacted by the kicker pin end 59*a* or 61*a* in the course of a cycle only if the interposer 41*a* is at the forward or operated position. As previously described, the tapered tip 63 of interposer 41*a* rides downwardly along roller 44*a*, as well as forwardly, as it is advanced to the operated position. This pivots tab 96 upwardly to the position at which it will be contacted by the kicker pin 59*a* or 61*a* at a later stage in the same cycle.

Figure 5:
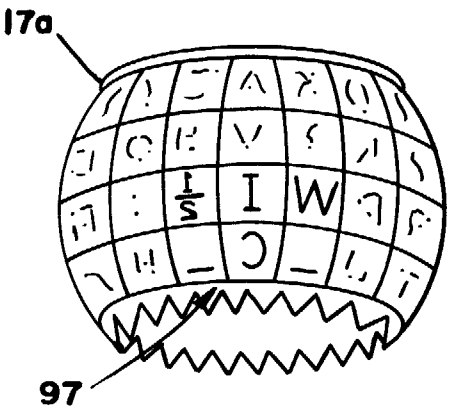
FIG. 5 is a perspective view of a portion of a modified typewriter printing element which may advantageously be employed on a typewriter which is operated through the baseplate attachment of the preceding figures.

The availability of dead key print cycles serves to eliminate the need for a back space cycle prior to an underscore print cycle at a previously printed character space during automatic typing. FIG. 5 illustrates a modified printing element 17*a* which may be used in the typewriter to also eliminate two case shift cycles heretofore employed in the course of underscoring a lowercase character during automatic typing. Printing element 17*a* may be similar to prior elements of the kind except insofar as one of the lowercase character areas, the "=" character area in this example, is eliminated and replaced with an additional underscore mark 97. In the control logic, the binary code or specific set of print signals that formerly represented the "=" character becomes representative of the lowercase underscore.

Referring again to FIG. 1, the control means 14 for the attachment 12 may be basically of known forms except insofar as prior circuits of this kind do not provide for dead key signals in conjunction with a set of print signals when appropriate. One example of a known control circuit suitable for operating an attachment 12 of this type in response to a sequence of six bit sets of coded signals indicative of print and function operations to be performed is described in detail in prior U.S. Pat. No. 3,453,379 of Lawrence Holmes, Jr., issued July 1, 1969 and entitled, *COMMUNICATIONS SYSTEM*. Other control circuits suitable for this purpose are also known to the art. Such control circuits can readily be adapted to generate a seventh bit or dead key signal to accompany the sixth bit print code signals when that is appropriate for the purposes of the present invention. Adaptations of the known systems for this purpose may take a number of forms depending on the nature of the installation, an example of the dead key signal generating system 99 suitable for a word processing or editing typewriter installation being depicted in FIG. 6.

Figure 6:
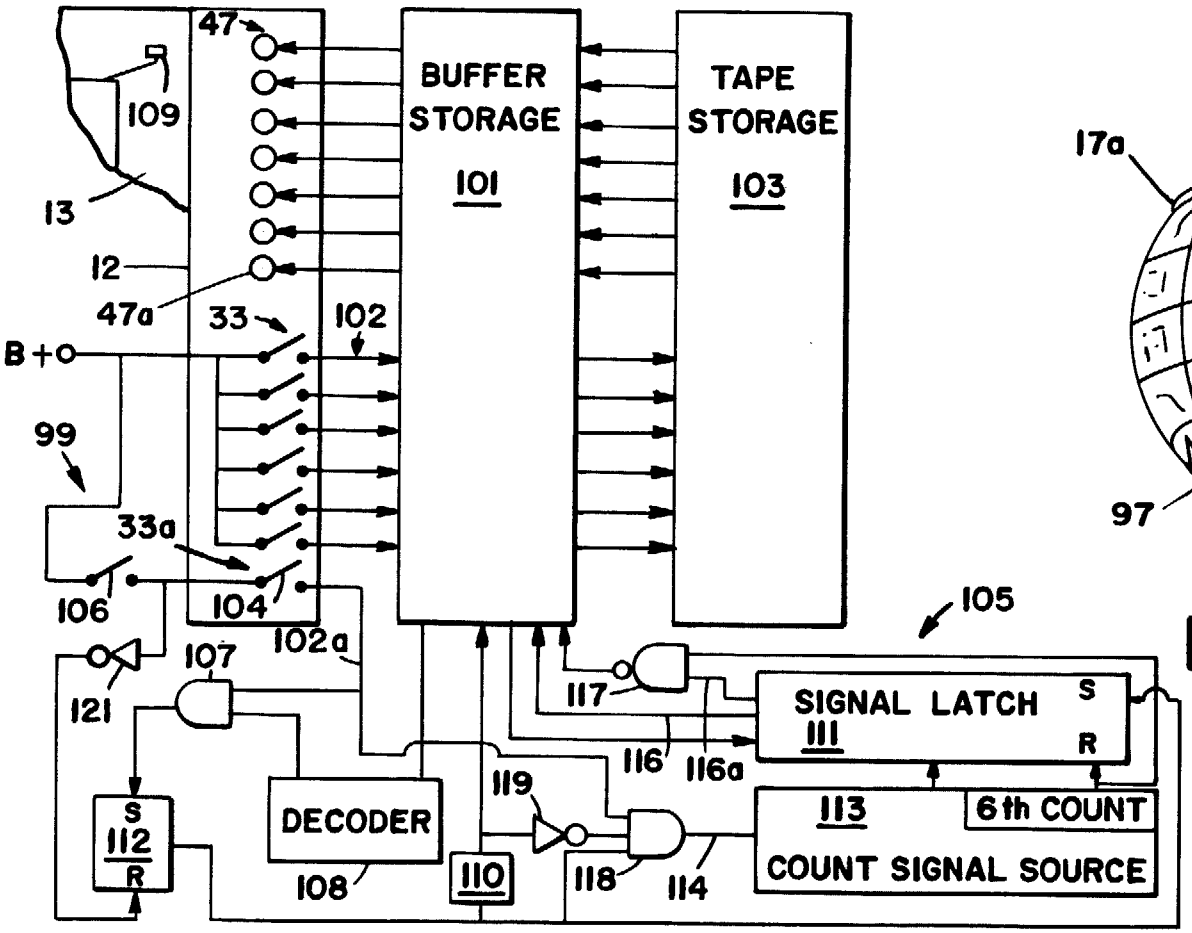
FIG. 6 is a schematic diagram illustrating an example of means by which the control circuit may transmit a dead key signal in conjunction with certain print signals which are to be printed under dead key conditions.

Referring to FIG. 6, in a word processing typewriter installation, the previously described six print operation sensing switches 33 of the attachment 12 each generate and transmit a separate bit component of the six bit sets of print signals to a buffer storage 101 through separate signal channels 102. The buffer storage 101 temporarily holds a current sequence of such signal sets and provides for signal modifications, such as resequencing of the set of signals when appropriate, after which the sets of signals are stored at a tape storage 103 for example. Tape storage 103 provides for subsequent retrieval and playback to the attachment 12 through buffer storage 101. During the playback or automatic typing phase, the sets of storage signals are sequentially delivered to the previously described six print interposer control actuators 47 with one of the six bits of each set being transmitted to a separate one of the actuators 47. This initiates successive print operations of the typewriter in the manner previously described.

The simplest method of adding a seventh or dead key bit to a set of signals is to provide an additional set of normally open switch contacts 104 at the cycle clutch operation sensing switch 33*a* (also shown in FIG. 1) which preexisting switch is momentarily closed during each typewriter operation cycle as the cycle clutch 29 (shown in FIG. 2) operates. Returning to FIG. 6, the typist may be provided with a normally open control switch 106 situated on or adjacent the attachment 12 or the typewriter and which is connected between the additional cycle clutch switch contacts 104 and the source B+ of operating current for the attachment. If the typist is about to initiate a print operation of the typewriter for a character requiring a dead key cycle, such as a character to be underscored or to be emphasized by multiple printings at the same character space, the typist may first close the control switch 106 before striking the character print key. When the character print operation is then initiated by the typist, cycle clutch sensing switch contacts 104 momentarily close to generate and transmit the seventh or dead key signal bit on a seventh channel 102*a*. In the simplest adaptation of existing systems to the dead key operations of the present invention, the dead key signal bit on channel 102*a* may be directly transmitted to the buffer storage 101 and on to tape storage 103 along with the other bits of the set of signals to which the dead bit belongs. During automatic typing the added dead key bit is then returned from tape storage 103 through buffer storage 101 along with the other bits of the set and is transmitted to the additional or dead key interposer control actuator 47*a* of attachment 12. This produces a dead key cycle in the manner previously described.

The above described method of generating and processing the dead key signal bits complicates the typist operations under certain circumstances. For example where emphasis is to be added by repetitive printings of characters at each of a series of successive character spaces, the typist must reoperate the control switch 106 after the repetitions of each successive one of the characters have been completed. It is preferable that the typist be able to close the control switch 106 at the start of a series of characters to be emphasized, type the several characters without interruption for further control switch manipulations and then open the control switch when unemphasized printing is to be resumed. An emphasis circuit 105 enables this more convenient mode of operation.

In the circuit as depicted in FIG. 6, the seventh or dead key bit channel 102*a* does not connect directly with buffer storage 101 but is instead connected to one input of a two input AND gate 107. Other input of AND gate 107 is connected to the output of a binary signal decoder 108 which detects the arrival of a set of print signals, identifying a predetermined specific character, at buffer storage 101 from the print operation sensing switches 33 of the attachment 12. In this example the predetermined set of signals detected by decoder 108 is the signal set for the letter H. Thus if the typist has closed the control switch 106 and then strikes the H print key 109 of the typewriter 13 both inputs of AND gate 107 are on and the output of the AND gate is then on or enabled. It may be noted that a print key 109 of the typewriter is here being used to initiate a control function, specifically emphasis of one or more succeeding characters. This temporary conversion of the print key 109 to serve a control code entry function requires that the set of print signals generated by print sensing switches 33 of the attachment 12 in response to such a depression of the print key 109 be suppressed so that an unwanted print signal set will not be stored in tape storage 103 and subsequently printed out during automatic typing. For this purpose the output of AND gate 107 sets a flip-flop 112 which then causes suppression of the unwanted set of print signals in the buffer storage as will hereafter be described.

A character signal latch or hold circuit 111 is coupled to buffer storage 109 to detect and temporarily store the next set of print signals that enters the buffer storage following setting of the latch circuit 111. The output of AND gate 107 is coupled to the set input of a flip-flop 112. The output of the flip-flop 112 is coupled to the set input of the latch circuit 111. Thus when AND gate 107 is enabled as a result of the typists closing of the control switch 106 and operation of H key 109, flip-flop 112 is set and, in turn, sets latch circuit 111. Latch circuit 111 then detects and stores the next set of print signals produced by the typists operations at the typewriter 13. The character signal latch circuit 111 is then caused to reintroduce the stored set of signals into buffer storage 101 six times in succession with each repetition except the last having the additional seventh or dead key bit. The repetitions of the stored set of print signals, including the additional or dead key bit with all but the last of the repetitions are stored in sequence at tape storage 103. Thus upon subsequent retrieval from the tape storage and printout at typewriter 13, the character represented by the repeated set of print signals is repetitively typed at the same character space on the paper and thus appears with boldface emphasis.

The character signal latch circuit 111 is controlled for the above described purposes by a count signal generator 113 of the form which responds to a signal at an input 114 by generating a sequence of six count signals each of which fires or triggers the latch circuit 111 to reintroduce the stored print signal set into buffer storage 101. For simplicity of illustration, the six channel signal path from latching circuit 111 through which the six print code signal bits are reintroduced into buffer storage 101 is represented in FIG. 6 by a single line 116. The signal path for the seventh or dead key bit is represented by a separate line 116*a* as it includes a NAND gate 117 for suppressing the dead key signal bit during the sixth and final reintroduction of the stored signal set. The sixth or final count signal from count signal generator 113 is transmitted to one input of the NAND gate 117 to disable the gate during transmission of the final repetition of the stored signal set from latching circuit 111 to buffer storage 101. The sixth count signal also resets the latching circuit 111 to clear the stored signal set from the circuit 111.

To actuate the count signal generator 113 as a set of signals to be repeated enters the buffer storage 101 and latching circuit 111, dead key signal line 102*a* is coupled to count signal generator 113 through one input of a three input AND gate 118. Another input of AND gate 118 is connected to the output of flip-flop 112 through a signal inverter 119 and a monostable multivibrator 110 which produces a single brief pulse when the flip-flop is first set by the control H set of signals as previously described. The third AND gate 118 input is connected to the output of flip-flop 112. Thus AND gate 118 is enabled, to actuate count signal generator 113, by the momentary closure of cycle switch contacts 104 which occurs as a set of print signal bits is being produced at the attachment 12 but only under the conditions that control switch 106 is closed, flip-flop 112 is set and the set of print signals is not the initial control H set which conditions the circuit for emphasis printing.

The single pulse output of monostable multivibrator 110 is also transmitted to buffer storage 101 to initiate suppression of the control H set of signals that was generated to begin the boldface printing mode as previously described.

The reset input of flip-flop 112 is coupled to the B+ current source through a signal inverter 121 and control switch 106. Thus when the typist opens the control switch 106 to end the boldface mode of printing, flip-flop 112 is reset and the emphasis circuit 105 is inactivated.

Operation

In operation, the attachment 12 is emplaced at the underside of the typewriter 13 in position where the several arms 34 for operating the signal generating switches 33 of the attachment and the arms 36 and interposer fingers 38 for actuating the typewriter in response to signals each extend to the appropriate locations within the typewriter as described in my hereinbefore identified prior U.S. Pat. No. 3,452,851. At that position of the attachment 12, the upper end of trigger finger 81 is situated immediately behind the lower end of the escapement trigger member 22 of the typewriter as best seen in FIG. 2.

In the absence of energization of the dead key interposer control actuator 47*a* by a dead key signal, the attachment 12 functions in the known manner as described in my above identified U.S. Pat. No. 3,658,161, to generate six bit binary signals indicative of operations at the typewriter keyboard and to initiate typewriter operations during automatic printing in response to similar signals. Referring to FIG. 3, receipt of a set of print signals initiates 180° of rotation of the attachment filter shaft 49 in the manner previously described and, depending on the specific character identified by the incoming set of signals, one or more of the print interposer actuators 47 is energized to draw the adjacent driver member 54 downward. As the filter shaft 49 rotates, kicker pins 58 then momentarily shift one or more of the print interposers 41 forward to condition the typewriter to print that specific character. In the absence of a dead key signal in conjunction with the print signal, driver member 54*a* of the dead key interposer 41*a* is not drawn downward into engagement with the associated filter shaft kicker pin 58*a*. Thus the dead key interposer 41*a* remains at the unoperated rearward position and escape of the typewriter proceeds in the normal manner during the course of the print cycle.

If receipt of a set of print signals at the print interposer actuators 47 is accompanied by receipt of the dead key signal at actuator 47*a*, then driver member 54*a* is also deflected downward and an end 49*a* or 61*a* of the associated kicker pin drives the dead key interposer forward to the operated position at the start of the print cycle. Through cable 70 and transfer link 73, the interposer motion pivots trigger finger 81 of the attachment forward. This causes the trigger finger 81 to pivot trigger member 22 of the typewriter to the position at which operation of the typewriter escapement means cannot occur.

The print interposers 41 are driven forwardly only momentarily at the start of a print cycle and then restore to the unoperated positions well prior to completion of the cycle. Dead key interposer 41*a* is held at the forward or operated position for a longer portion of the cycle to prevent escape of the typewriter during the cycle. In particular, as the dead key interposer 41*a* is advanced to the operated position, notch 94 moves in to register with detent 92 of the latch member 89. Spring 93 then draws the detent 92 into notch 94 and the dead key interposer is thereby held at the forward or operated position until such time as the detent is withdrawn from the notch. Withdrawal of the detent 92 from notch 93 at a later stage of the print cycle occurs when the filter shaft kicker pin end 59*a* or 61*a* completes 110° of the 180° of rotation of a complete cycle and contacts tab 96 at the back end of latch member 89 to momentarily pivot the latch member in a direction which lifts the detent 92 out of the notch 94. This allows spring 84 to draw the dead key interposer 41*a* backward to the unoperated position in preparation for a subsequent cycle of operation. As the typewriter escapement 21 will not operate after that stage of the cycle, the accompanying retraction of the trigger finger 81 and release of the typewriter escapement trigger 22 does not result in escape movement. The following set of print signals will result in printing of a character in the same space that the previous character was printed at.

As previously described, the control circuit 14 may be caused to add the seventh or dead key signal bit to a set of print signals under any of a number of conditions at which dead key printing may be advantageous. During automatic printing, a just printed alpha-numeric character may be underscored without requiring a back space operation between the two cycles. If the specialized printing element 17 of FIG. 6 is present in the typewriter, underscoring of a lowercase letter may also be accomplished without the upshift function cycle and subsequent downshift function cycle which have been the previous practice. Thus only two cycles are required to underscore a lowercase character as contrasted to the six time periods which have previously been the practice thereby increasing underscoring speed for lowercase characters by 300 percent. As also previously described, bold face emphasis may quickly and easily be provided for selected characters, words or phrases by repetitively printing each component character a plurality of times before proceeding on to the next character. A character may be repetitively printed at the same space, without requiring back spacing, by energizing the dead key interposer control actuator 47*a* at each of a sequence of identical print cycles other than the last print cycle of the sequence. The dead key signal is not provided during the last of the repetitive print cycles in order to allow escape to proceed in the normal manner in preparation for printing of the next character. Still other advantageous uses of the dead key means 11 may be made. For example, printing of an exclamation point by combining an apostrophe and a period in the same character space may be accomplished, at typewriters which lack an exclamation point key, without back spacing between the two print operations.

While the invention has been described with respect to a specific embodiment, many variations are possible and it is not intended to limit the invention except as defined in the following claims.

I claim:

1. In an attachment for generating sets of electrical signals which identify successive character printing operations at a typewriter and for initiating operations of a typewriter in response to such sets of electrical signals which identify successive printing operations to be performed, the typewriter having escapement means for causing character spacing movement to a succeeding character space following printing of a character in response to a set of print signals, the improvement comprising:

said attachment having control means for optionally adding a dead key bit to selected ones of said print signal sets, and said attachment being provided with dead key means for temporarily disabling said escapement means of said typewriter in response to sets of said print signals which include said dead key bit.

2. A typewriter attachment as described in claim 1 wherein the typewriter has cycling means for driving elements of the typewrite which undergo movement during a print operation and wherein said cycling means is actuated for a predetermined cycle period following each initiation of a print operation, wherein said dead key means of said attachment disables said escapement means of said typewriter for at least the portion of said period during which operation of said escapement means would otherwise occur.

3. A typewriter attachment as defined in claim 1, the escapement means of the typewriter having a trigger member movable between a first position at which operation of said escapement means is prevented and a second position at which said escapement means is conditioned for operation, wherein said dead key means of said attachment includes a movable trigger finger positioned to extend adjacent said trigger member of same typewriter when said attachment is engaged with said typewriter, said trigger finger having an operated position at which said trigger member of said typewriter is maintained at said first position thereof by said trigger finger and having an unoperated position at which said trigger member of said typewriter is released for movement to said second position thereof.

4. A typewriter attachment as defined in claim 3 further including electrically operated actuator means for causing movement of said trigger finger to said operated position thereof in response to said sets of print signals which include said dead key bit.

5. In an attachment for initiating operations of a typewriter in response to electrical signals which identify successive operations to be performed, the typewriter having escapement means for causing character spacing movement to a succeeding character space following printing of a character in response to a print signal, the escapement means of the typewriter having a trigger member movable between a first position at which operation of said escapement means is prevented and a second position at which said escapement means is conditioned for operation, the improvement comprising:

said attachment being provided with dead key means for temporarily disabling said escapement means of said typewriter in response to a dead key signal in conjunction with said print signal, wherein said dead key means of said attachment includes a movable trigger finger positioned to extend adjacent said trigger member of said typewriter when said attachment is engaged with said typewriter, said trigger finger having an operated position at which said trigger member of said typewriter is maintained at said first position thereof by said trigger finger and having an unoperated position at which said trigger member of said typewriter is released for movement to said second position thereof, and further including electrically operated actuator means for cuasing movement of said trigger finger to said operated position thereof in response to a print signal accompanied by a dead key signal, and latching means for holding said trigger finger at said operated position thereof for a predetermined period following termination of said print signal and dead key signal.

6. A typewriter attachment as defined in claim 5, the typewriter having a motor and cycling means operated thereby for driving components of the typewriter in the course of print operations, said cycling means being actuated for a predetermined cycle period in conjunction with each print operation, wherein said attachment further includes drive means for effecting said movement of said trigger finger and for operating said latching means with mechanical power obtained from said typewriter motor through said typewriter cycling means.

7. A typewriter attachment as defined in claim 3 wherein said trigger finger of said attachment extends adjacent said trigger member of said typewriter while being directly fastened only to said attachment.

8. The apparatus of claim 1, said typewriter having a drive motor and rotary cycling means for operating character imprinting means and having a plurality of code bails different combinations of which may be shifted to condition the typewriter for printing specific characters, said typewriter attachment having:

plate means for supportng components of said attachment, said plate means being fastenable to said typewriter, a rotary filter shaft carried by said plate means, means for coupling said filter shaft to said cycling means of the typewriter to turn the filter shaft synchronously with the typewriter cycling means, a plurality of interposers carried by said plate means and each having a finger which extends to a separate one of said typewriter code bails when said attachment is engaged with said typewriter whereby movement of any of said interposers shifts the associated one of said typewriter code bails, said interposers each having a driver member extending toward said filter shaft and which may be shifted into engagement therewith whereby turning of said shaft moves the interposer to shift the associated one of said typewriter code bails, a plurality of electrically operated actuators secured to said plate means each being positioned to shift a separate one of said driver members of a separate one of said interposers into engagement with said filter shaft, wherein said dead key means of said attachment further includes:

an additional interposer carried by said plate means and having an additional driver member extending toward said filter shaft that may be shifted into engagement therewith whereby turning of the filter shaft moves the additional interposer to an operated position thereof, an additional electrically operated actuator secured to said plate means and which is actuated in response to said dead key signal to shift said additional driver member into engagement with said filter shaft, and means for blocking operation of said typewriter escapement means while said additional interposer is at said operated position thereof.

9. In an attachment for initiating operations of a typewriter in response to electrical signals which identify successive operations to be performed, the typewriter having escapement means for causing character spacing movement to a succeeding character space following printing of a character in response to a print signal, said typewriter having a drive motor and rotary cycling means for operating character imprinting means and having a plurality of code bails different combinations of which may be shifted to condition the typewriter for printing specific characters, the improvement comprising:

said attachment being provided with dead key means for temporarily disabling said escapement means of said typewriter in response to a dead key signal in conjunction with said print signal, said typewriter attachment having:

plate means for supporting components of said attachment, said plate means being fastenable to said typewriter, a rotary filter shaft carried by said plate means, means for coupling said filter shaft to said cycling means of the typewriter to turn the filter shaft synchronously with the typewriter cycling means, a plurality of interposers carried by said plate means and each having a finger which extends to a separate one of said typewriter code bails when said attachment is engaged with said typewriter whereby movement of any of said interposers shifts the associated one of said typewriter code bails, said interposers each having a driver member extending toward said filter shaft and which may be shifted into engagement therewith whereby turning of said shaft moves the interposer to shift the associated one of said typewriter code bails, a plurality of electrically operated actuators secured to said plate means each being positioned to shift a separate one of said driver members of a separate one of said interposers into engagement with said filter shaft, wherein said dead key means of said attachment further includes:

an additional interposer carried by said plate means and having an additional driver member extending toward said filter shaft that may be shifted into engagement therewith whereby turning of the filter shaft moves the additional interposer to an operated position thereof, an additional electrically operated actuator secured to said plate means and which is actuated in response to said dead key signal to shift said additional driver member into engagement with said filter shaft, means for blocking operation of said typewriter escapement means while said additional interposer is at said operated position thereof, a latch member carried by said plate means and being movable between a latch position at which said additional interposer is held at said operated position thereof and an unlatching position at which said additional interposer may return to the unoperated position thereof, means for urging said latch member into said latching position thereof when said additional interposer is at said operated position, and release means for moving said latch member to said unlatching position when said filter shaft is at a predetermined rotational position thereof.

10. The apparatus of claim 9 wherein said additional interposer is slideable relative to said plate means between the operated and unoperated positions of the additional interposer and has a notch shaped for receiving a detent, said latch member being pivotally carried on said plate means and having a detent portion located to enter said notch as said additional interposer is pivoted to said operated position thereof and to withdraw from said notch as said latch member is pivoted to said unlatching position by said release means.

11. The apparatus of claim 1, wherein the typewriter has an uppercase condition of operation for printing uppercase characters and has a lowercase condition of operation for printing lowercase characters and has a printing element with a plurality of different character imprinting areas thereon including a first underscore mark area located on said printing element for printing of an underscore mark when said typewriter is in the uppercase condition, further including a second underscore mark area located on said printing element in position for imprinting an underscore mark when said typewriter is in the lowercase printing condition, wherein said typewriter attachment has control means for providing said dead key signal to said dead key means in conjunction with a print signal for initiating printing of an underscore including means for printing an underscore with said first underscore mark when the character to be underscored is uppercase and for printing an underscore character with said second underscore mark when the character to be underscored is a lowercase character.

12. The apparatus of claim 1 further including additional control means for repetitively providing a predetermined specific set of said character print signals to said attachment and for providing said dead key signal bit thereto in conjunction with repetitions of said predetermined specific print signal set whereby the character identified by said specific print signal set is printed in boldfaced print.

* * * * *